United States Patent [19]

Kasinskas

[11] 4,161,280

[45] Jul. 17, 1979

[54] METHOD AND APPARATUS FOR DISPENSING A DEICER LIQUID

[75] Inventor: Michael M. Kasinskas, Cheshire, Conn.

[73] Assignees: State of Connecticut, Hartford, Conn.; United States of America, Washington, D.C. ; part interest to each

[21] Appl. No.: 841,749

[22] Filed: Oct. 13, 1977

[51] Int. Cl.[2] ..... E01H 10/00

[52] U.S. Cl. ..... 239/1; 134/172; 239/169; 239/172; 239/589

[58] Field of Search ..... 239/1, 127, 148, 164, 239/169, 172, 175, 176, 287, 589, 601; 134/115 R, 172, 198

[56] References Cited

U.S. PATENT DOCUMENTS

| | | | |
|---|---|---|---|
| 826,890 | 7/1906 | Schafer | 239/172 |
| 1,958,085 | 5/1934 | Hammon | 239/589 |
| 3,487,828 | 1/1970 | Troy | 239/601 X |
| 3,902,667 | 9/1975 | Jackson | 239/172 X |
| 3,987,964 | 10/1976 | Pittman et al. | 239/287 X |

FOREIGN PATENT DOCUMENTS

| | | | |
|---|---|---|---|
| 999185 | 1/1952 | France | 239/601 |

OTHER PUBLICATIONS

Kyser, J. O., *Brine Solution Removes Stubborn Ice* in Public Works Magazine, pp. 67, 68 and 89, Jan. 1971.

Scotto, G. E., *Liquid Treatments of Commercial $CaCl_2$ in Winter Road Maintenance* in Snow Removal and Ice Control Research, Special Report 115 of U.S. Army Cold Regions Research and Engineering Laboratory and Highway Research Board, pp. 156–171, Nov. 20, 1970.

Forbes, C. E. et al., *Snow and Ice Control in California,* in Snow Removal and Ice Control Research Special Report 115 of U.S. Army Cold Regions Research and Engineering Laboratory and Highway Research Board, pp. 177–193, Nov. 20, 1970.

*Primary Examiner*—Robert B. Reeves
*Assistant Examiner*—Andres Kashnikow

[57] ABSTRACT

The invention provides method and apparatus for applying a deicer liquid such as brine to a layer of frozen water (snow, ice, sleet, etc.) on a ground surface. The method provides for delivering brine or the like to a plurality of liquid directing nozzles at a pressure of about 21.1 kg/cm$^2$ (300 psi) and distributing the liquid onto the frozen water from the nozzles as coherent laminar streams having a turbulent outer boundary layer. The streams of liquid are directed at an incident angle of between about one to 5 degrees to the layer of frozen water. Preferably, the streams of liquid are also directed at a heading which defines an acute angle with the direction of movement of the nozzles. The apparatus, which is adapted to be mounted on a truck or other ground vehicle, includes a liquid storage tank, a high pressure liquid pump, a distribution header having a plurality of nozzles connected thereto and conduits interconnecting the foregoing. A nozzle support undercarriage supports the header and nozzles beneath the truck above the frozen water surface. The header is adjustable on the undercarriage to correctly orient the nozzles.

17 Claims, 11 Drawing Figures

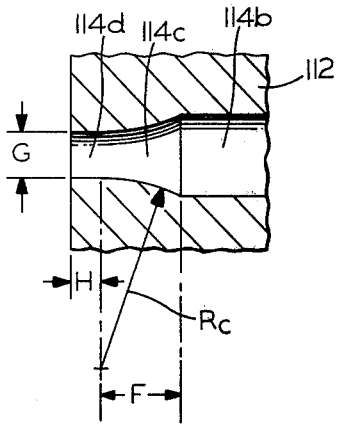
FIG.6A
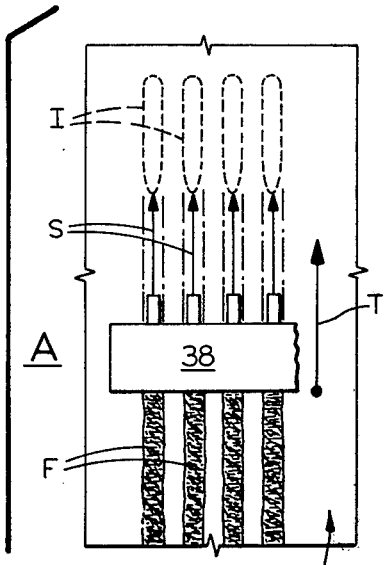
FIG. 10
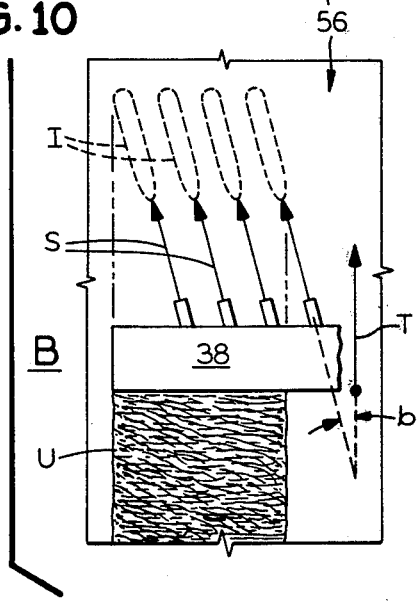

METHOD AND APPARATUS FOR DISPENSING A DEICER LIQUID

The U.S. Government has rights in this invention pursuant to an Agreement between the Connecticut Department of Transportation and the Federal Highway Administration.

BACKGROUND OF THE INVENTION

The present invention is concerned with a method and apparatus for applying a deicer liquid to frozen water on a ground surface and, in particular, with applying a deicer liquid to frozen water on roadways or any other surface from which it is desired to remove the frozen water.

It is, of course, a common practice of long standing to apply salt (NaCl), usually in the form of rock salt, or calcium chloride ($CaCl_2$) in pellet or flake form to snow, ice, or the like in order to soften it to facilitate removal of the thus-softened snow, etc. by mechanical means. The salt or calcium chloride lowers the melting temperature of the frozen water causing the areas on which the salt is applied to melt.

There are several shortcomings to this approach, not the least of which is the concern for environmental damage due to tonnage quantities of salt or calcium chloride being applied to roads and highways and ultimately finding its way into adjacent fields and streams. Further, the salt is corrosive and adversely affects vehicles, metal fixtures such as fence rails and light posts adjacent the highways and the concrete itself. In addition, a crystalline material such as salt is inert as a deicer until it has been dissolved. This requires contact with moisture. The moisture, acting as a solvent, will dissolve the salt particles and the resultant brine is the active deicing agent. The speed at which the inert crystalline material becomes an active deicer is thus dependent upon the available moisture. The latter difficulty can be overcome by dissolving the chemical and, for example, in the case of salt, applying it as a brine solution. Thus, the use of water solutions to apply the chemicals has been the subject of several test programs in California, North Dakota and in Italy. For example, see the article "Brine Solution Removes Stubborn Ice," by James O. Kyser, *Public Works Magazine,* January 1971; "Liquid Treatments of Commercial Calcium Chloride in Winter Road Maintenance," by G. E. Scotto, *HRB Special Report* 115; "Snow and Ice Control in California," by C. E. Forbes, C. F. Stewart and D. L. Spellman, *HRB Special Report* 115, Page 181.

In order to reduce both the adverse environmental impact and the cost of employing brine or other liquids as well as to reduce the corrosive effect of brine or the like, it is desirable to obtain the maximum degree of softening the frozen water with application of the minimum amount of brine or the like.

One difficulty with prior liquid deicer application techniques is that the liquid has a tendency, particularly when the frozen water layer is hard ice or sleet, to run off the surface without penetrating the frozen water layer sufficiently. This aggravates the pollution problem and wastes the salt or calcium chloride. Another difficulty is poor distribution of the liquid, which tends to gather in pools in low places on the roadway, resulting in too much salt or calcium chloride being concentrated in one location and insufficient amounts in another location. If spray-on type applications are employed to provide even distribution over the surface, the liquid does not provide any suitable mechanical breaking up of the frozen water layer.

It is accordingly an object of the present invention to provide a novel method for applying a deicer liquid to a layer of frozen water on a ground surface which provides for penetration of the deicer liquid into the frozen water layer, and highly efficient mechanical as well as chemical action of the liquid on the frozen water.

It is another object of the invention to provide a novel, efficient and relatively inexpensive apparatus to apply a deicer liquid onto a layer of frozen water on a ground surface in the form of coherent laminar streams of liquid having a turbulent outer layer.

It is another object of the present invention to provide a novel method and apparatus which enable the application of a deicer liquid such as brine to a frozen water layer in a highly efficient manner to promote mechanical breaking of the frozen water layer by the streams of liquid and even and efficient distribution of the deicer liquid onto the frozen water layer, thus enhancing the softening and melting chemical effect of the deicer liquid.

Other objects and the advantages of the present invention will become apparent from the following description of the invention.

SUMMARY OF THE INVENTION

The present invention provides a deicer apparatus adapted to be mounted on a ground vehicle for applying deicer liquid to a layer of frozen water on the ground surface over which the vehicle travels. The apparatus comprises a deicer liquid storage tank having a tank outlet, and pump means having pump inlet and a pump outlet and adapted to pressurize a liquid received through the pump inlet to a pressure of at least about 14.6 $kg/cm^2$. First conduit means connecting the tank outlet in liquid flow communication to said pump inlet are provided, as is a plurality of liquid directing nozzles having a body portion in which is provided a liquid passage terminating in a discharge opening and configured to discharge pressurized liquid from the pump through the discharge opening as a coherent laminar stream having a turbulent outer boundary layer. A second conduit means connects the pump outlet in liquid flow communication with the nozzles. Nozzle support means carrying the nozzles and including means thereon for mounting the support means on a ground vehicle are included. The nozzle support means is configured to support the nozzles above the ground surface for movement thereover by the vehicle. The nozzles are disposed on the support means to orient the discharge openings to lead in the direction of vehicle forward travel and to direct the streams of liquid from the nozzles at an incident angle to the layer of frozen water of between about one to five degrees.

In one aspect of the invention, the nozzles are disposed on the support means to further orient the nozzle discharge openings to direct the streams of liquid from the nozzles at a heading defining an acute angle with the direction of movement of the nozzles.

In accordance with certain aspects of the invention, the above-mentioned heading defines an angle of about ten degrees with the direction of movement of the nozzles and the nozzles are disposed on the support means to orient the discharge openings to direct the streams of liquid at an incident angle of about three degrees.

Another aspect of the invention provides that the second conduit includes an elongated distribution header providing a liquid flow path extending along its longitudinal axis, and a header connection segment connecting the liquid flow path in liquid flow communication with the pump outlet. The plurality of nozzles are connected to the distribution header in spaced apart relationship along the longitudinal axis thereof, and in liquid flow communication with the liquid flow path.

The present invention also provides a method of applying deicer liquid to frozen water on a ground surface, comprising the steps of: Pressurinzing a deicer liquid to at least about 14.6 kg/cm$^2$ and supplying the pressurized liquid of step (a) to a plurality of liquid directing nozzles having a body portion in which is provided a liquid passage terminating in a discharge opening. The liquid exits from the discharge openings as coherent laminar streams of liquid having a turbulent outer boundary layer. The method further includes orienting the nozzles relative to the ground surface to direct the streams of liquid onto the frozen water at an incident angle to the ground surface of between about one to five degrees, and moving the nozzles and thereby the streams of liquid across the ground surface in a direction generally parallel thereto, and whereby movement of the nozzles increases the relative velocity at which the streams impings upon the frozen water.

Other aspects of the invention include further orienting the nozzles to direct the streams of liquid at a heading which defines an acute angle with the direction of movement of the nozzles.

BRIEF DESCRIPTION OF THE DRAWINGS

FIG. 6A is an enlarged representation of the discharge opening end of the nozzle of FIG. 6;

FIG. 10 is a schematic representation in plan view of the different patterns of liquid application obtained by, respectively, directing the liquid stream at a heading parallel to the direction of nozzle movement, as shown at "A", and directing the liquid streams at a heading which defines an acute angle with the direction of nozzle movement, as shown at "B".

DETAILED DESCRIPTION OF THE PREFERRED EMBODIMENTS

Figure 1:
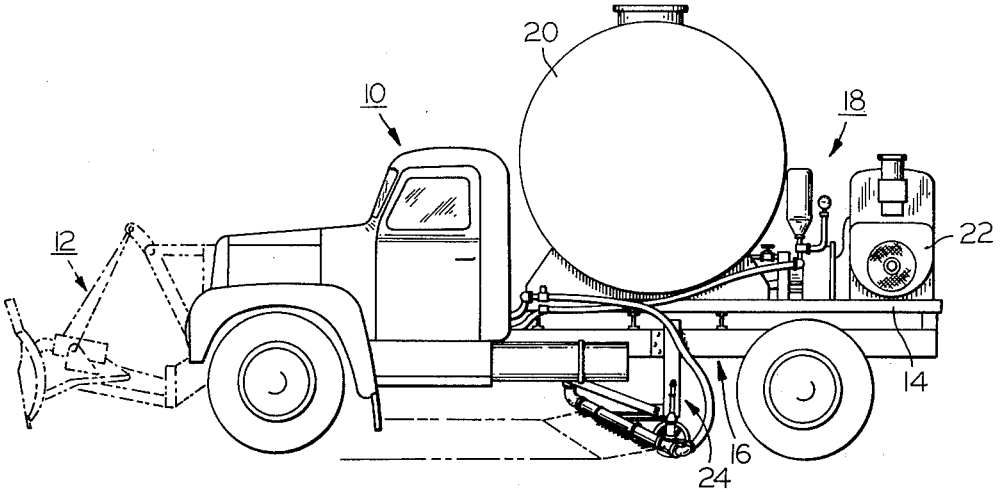
FIG. 1 is a side elevation view of a snowplow truck on which is mounted an embodiment of a deicer apparatus in accordance with the present invention.

Referring now to FIG. 1, there is generally indicated at 10 a ground vehicle comprising a conventional road truck which may be equipped in the conventional manner with a snowplow 12 indicated in dot dash outline in FIG. 1. Truck 10 has a platform bed 14 which is supported upon the truck chassis frame 16. A deicer apparatus comprising an embodiment of the present invention is generally indicated at 18. Deicer apparatus includes a deicer liquid storage tank 20 and pump means provided by a high pressure pump 22. Storage tank 20 and pump 22 together with an associated piping are supported upon platform bed 14. A nozzle support means generally indicated at 24 is mounted on chassis frame 16, suspended therebelow a short distance (e.g., about 7 to 8 cm) above the roadway on which truck 10 rides.

Figure 2:
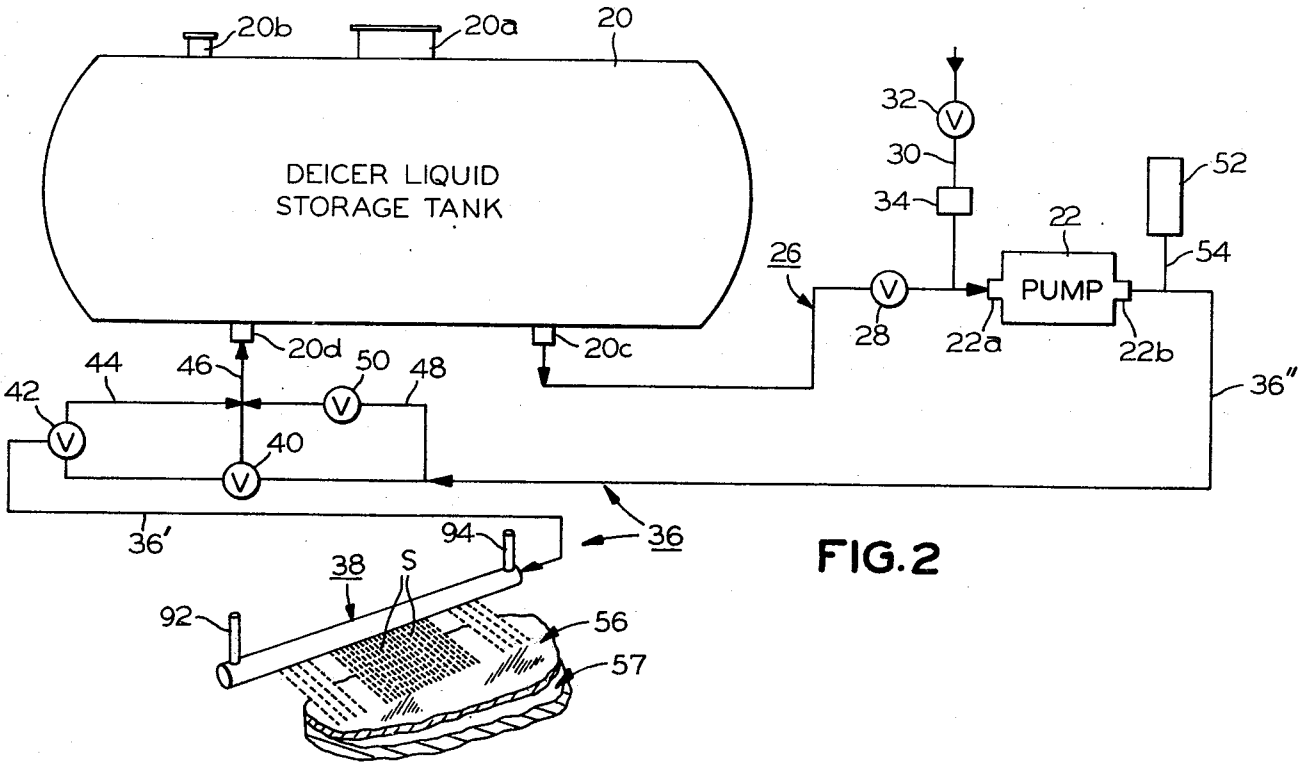
FIG. 2 is a schematic illustration of the deicer apparatus embodiment shown in FIG. 1.

Referring jointly to FIGS. 1 and 2, tank 20, which is shown in end view in FIG. 1, is illustrated in the schematic rendition of FIG. 2 in side view and has the usual manhole and inspection openings **20*a*, 20*b* as well as a tank outlet 20*c* and tank inlet 20*d*. As shown in FIG. 2, pump 22, which is illustrated schematically therein, has a pump inlet 22*a* and a pump outlet 22*b*. A first conduit 26 connects tank outlet 20*c* in fluid flow communication to pump inlet 22*a*. A first gate valve 28 is positioned in first conduit 26 between tank 20 and a fill line 30. Fill line 30 is adapted to be connected to a source of brine and includes a fill line gate valve 32 and a filter 34 to filter out particulate impurities. Fill line 30 is connected in liquid flow communication with first conduit 26 between first gate valve 28 and pump 22. A second conduit, generally indicated at 36, connects pump outlet 22*b* in fluid flow communication with a plurality of nozzles as described more fully hereinbelow. Filter 34 is designed to protect the nozzles from plugging by filtering out particulate matter large enough to plug these nozzles. Second conduit 36 includes a distributor header 38 to which a plurality of the aforesaid nozzles (not shown in FIG. 2) are connected in liquid flow communication. Second conduit 36 also includes a header connection segment 36', and a pump discharge segment 36''. Second conduit 36 is connected downstream of pressure relief valve 40, by means of a three-way valve 42, with bleeder line 44 which, in turn, connects with tank supply line 46. Tank supply line 46 is connected in liquid flow communication to tank inlet 20*d*. A bypass line 48 is connected to first conduit 36 upstream of pressure relief valve 40 and, via a quick-acting valve 50, to tank supply line 46. The aforementioned lines are connected to each other in liquid flow communication subject to control by their associated valves. A surge tank 52 is connected by means of a tee connector 54 to first conduit 36 downstream of and adjacent to pump outlet 22*b*. Distributor header surge columns 92, 94 are provided at opposite ends of distribution header 38. As indicated above, the nozzles connected to distribution header 38 are omitted from FIG. 2 for clarity of illustration. Streams of liquid discharged from the nozzles are schematically indicated by dotted lines in FIG. 2**.

From the description so far of FIGS. 1 and 2 it is seen that the apparatus provides a deicer liquid storage tank connected by a first conduit 26, which functions as a suction line to pump 22 which pressurizes liquid withdrawn from storage tank 20 and transmits it via second conduit 36, comprising a high pressure line, for discharge through a plurality of nozzles.

In order to fill deicer liquid storage tank, valve 28 is closed and valves 32 and 50 are opened to permit a deicer liquid, usually brine, to be pumped from a storage source (not shown in the drawings) via fill line 30, pump 22, second conduit 36, conduit 48 and tank supply line 46 via inlet 20*d* into deicer liquid storage tank 20. Three-way valve 42 is positioned during the filling operation so as to block second conduit 36 and divert the pressurized liquid via tank supply line 46 into tank 20. When tank 20 is appropriately supplied with liquid, fill line gate valve 32 and valve 50 are closed, valve 28 is opened, and fill line 30 is disconnected from the brine storage tank. The truck then is ready to proceed to the road or other surface to which the deicer liquid is to be applied.

Figure 8:
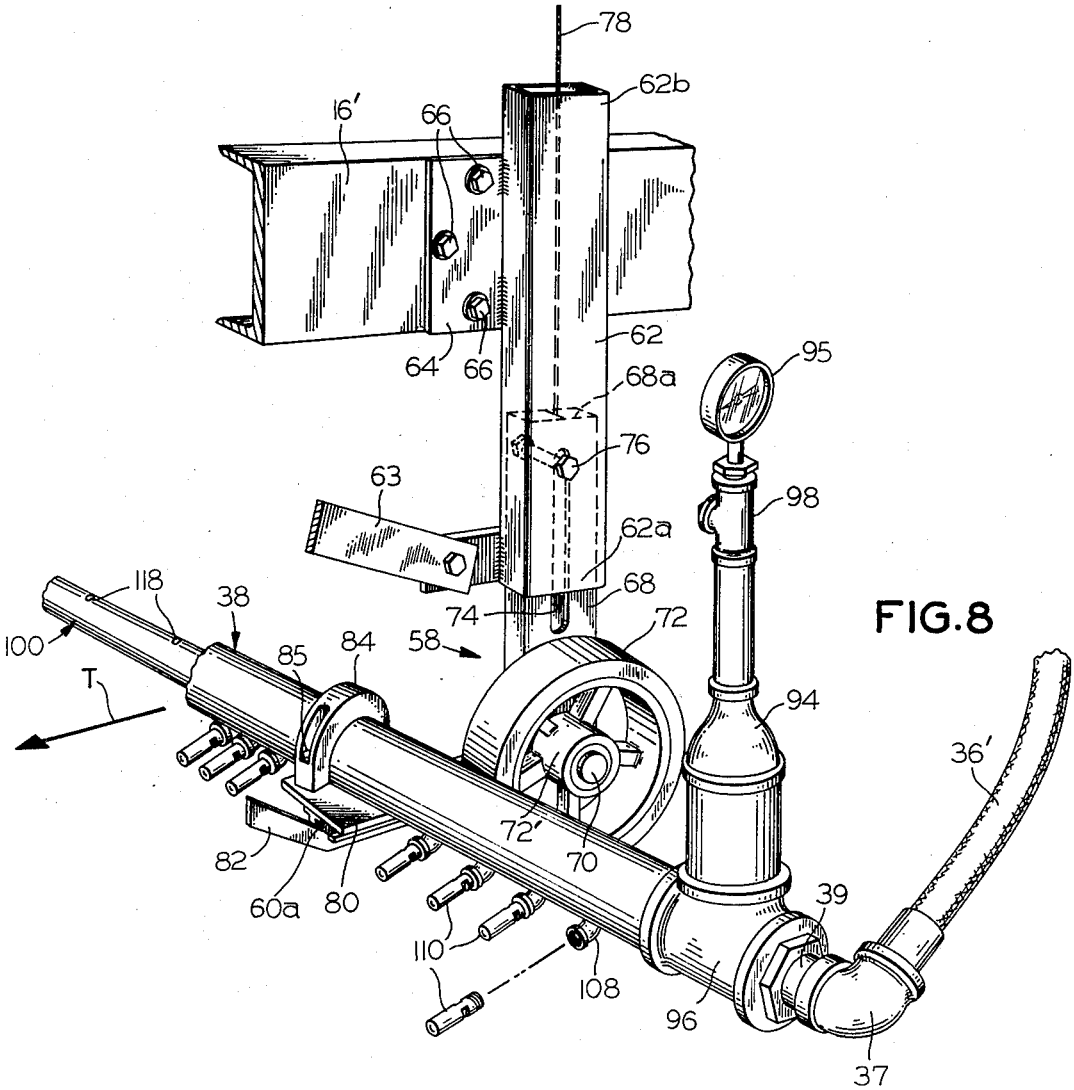
FIG. 8 is a partial perspective view of the distribution header and nozzle support means shown in FIGS. 1 and 7.
Figure 7:
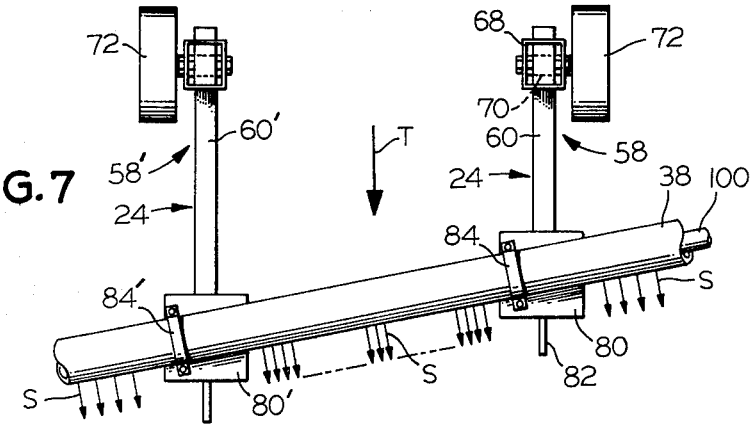
FIG. 7 is a partial plan view of the distribution header of FIG. 3 and the nozzle support means on which it is supported.

Referring to FIGS. 7 and 8, nozzle support means 24 is seen to comprise a pair of spaced apart undercarriage members 58, 58′ which are substantially identical in construction except for the length of their respective horizontal beam members 60, 60′ as shown in FIG. 7. Accordingly, the details of the structure are primarily explained with respect to undercarriage member 58 only, it being understood that the undercarriage member 58′ is identical thereto in all respects except for the length of its horizontal beam member 60 in order to accommodate the angular offset position of distribution header 38.

Still referring jointly to FIGS. 7 and 8, undercarriage 58 includes mounting means comprising a strut member including a steel box beam 62 which is affixed to chassis frame member 16′ in any suitable manner, preferably by welding box beam 62 to a steel plate 64 which may then be bolted by means of bolts 66 through suitable bolt hole openings made in chassis frame member 16′. A brace member 63 is fastened at one end to box beam 62 adjacent its lower end 62*a*, and at its other end to chassis frame 16 of truck 10 to strengthen the mounting of box beam 62 to chassis frame 16. Generally, the conventional chassis frame 16 of a truck 10 has at least a pair of spaced apart members such as chassis frame member 16, and undercarriage member 58′ is mounted in a similar fashion to a parallel spaced apart member (not shown) corresponding to chassis frame member 16′.

The strut member includes a member 68 of rectangular cross section and sized to be slideably received within box beam 62. At the lower end of strut member 68 an axle 70 passes through suitable openings provided in opposite walls of strut members 68, and supports hub 72′ of a wheel 72. Wheel 72 is preferably a solid rubber wheel having a steel hub and spider section. Member 68, which is a box beam of slightly smaller cross section than that of box beam 62, has a pair of elongated slots 74 formed, respectively, in opposite sidewalls thereof. Slots 74 extend longitudinally vertically along two opposite sidewalls of strut member 68 and the slot tops terminate short of the upper end 68*a* thereof, and the slot bottoms short of the openings through which axle 70 is received. A guide bolt 76 is passed through opposite sidewalls of box beam 62 at a distance above the lower end 62*a* thereof. Slots 74 of strut member 68 are received over guide bolt 76 and permit truck member 68 to be raised upwardly within box beam 62, as described in more detail hereinbelow.

A lifting cable 78 is secured to axle 70 by any suitable means and passes upwardly through box beam 62 and out the upper end 62*b* thereof. Lifting cable 78, in conjunction with a corresponding cable provided in undercarriage member 58′, is employed to raise strut members 68 and 68′ (FIG. 7) to increase the clearance of the assembly above the ground surface for purposes described hereinbelow. The cables are attached over a series of pulleys to a suitable power operated motor or the like. Generally, the strut members are of telescoping construction and adapted to be selectively moved between a retracted position and a lower liquid applying position above the ground surface.

Distribution header support members 60, 60′ have steel support plates 80, 80′ affixed thereto at the leading ends thereof, as determined with respect to the direction of forward travel of vehicle 10 indicated in FIGS. 7 and 8 by the arrow T. Support plates 80, 80′ are substantially square in shape and are affixed to their associated header support members 60, 60′ by welding or other suitable means. As shown in FIG. 8, the leading end of support member 60 is truncated in an upwardly slanted direction at 60*a* and a steel protective skid 82 having an upwardly slanted nose portion is welded to the bottom of member 60 to serve as a protective member against high spots or other obstacles which may exist on the roadway or ground surface over which the nozzle support means 24 is moved by truck 10, as described more fully hereinbelow. As shown in FIG. 7, the opposite or trailing ends of members 80, 80′ are passed through suitable openings in, respectively, lower portions of struts 68, 68′ and pivotably mounted relative thereto about axles 70 such that if protective skids 82, 82′ encounter an obstacle in the roadway, members 58, 58′ will pivot about their associated axles 70 to pass header 38 safely over the obstacle. Generally, members 60, 60′, which are preferably beams as illustrated, are normally disposed horizontally and the strut members (comprising members 62, 68) are disposed vertically.

Each of support plates 80, 80′ is provided with suitably placed holes therein through which respective U-shaped clamping members 84, 84′ are secured to plates 80, 80′ respectively by bolts 85 (FIG. 8). Clamping members 84, 84′ fit over a distribution header 38 and securely clamp it to plates 80, 80′.

Referring jointly to FIGS. 3, 4, 5, 7 and 8, distribution header 38 is seen to comprise a pipe or conduit of elongated construction providing a liquid flow path 86 extending along the longitudinal axis thereof. At one end 38*a* (FIG. 3) of distribution header 38 an elbow connector 88 connects surge column 90 in liquid flow communication with liquid flow path 86. Surge column 90 is topped with a tee connector 92 which is closed by plugs (unnumbered) which, like the plugs in surge column 94, provide connections for backwashing and rinsing of distribution header 38 for maintenance purposes. The other surge column 94 is connected in liquid flow communication to liquid flow path 86 at the opposite end 38*b* of distribution header 38 by means of a tee elbow connector 96. Surge column 94 is capped with a tee connector 98. A pressure gauge 95 (FIG. 8) is mounted on the connector 98 to permit monitoring of liquid pressure in distribution header 38.

Figure 3:
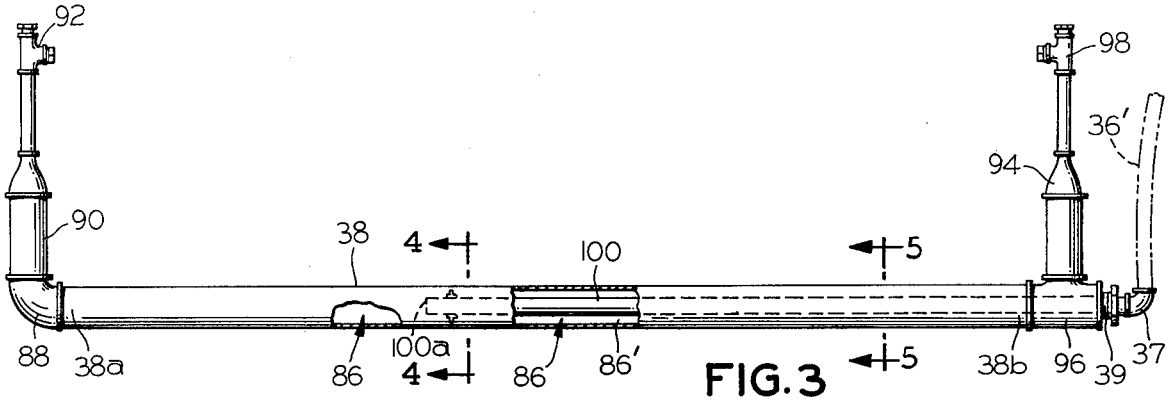
FIG. 3 is a front elevation view of a distribution header forming part of the embodiment illustrated in FIGS. 1 and 2, with the nozzles omitted for clarity of illustration.

Pressure gauge 95 is omitted from the drawing of FIG. 3 and tee elbow 96 is closed, at its end opposite the end to which end 38*b* of distribution header 38 is connected, by a bushing plug 39. Header connection segment 36′ of second conduit 36 is connected by an elbow 37 to bushing plug 39 and in liquid flow communication with diffuser conduit 100 and, via the latter, with distribution header 38.

Figure 4:
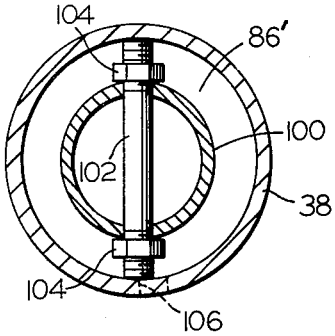
FIG. 4 is a section view taken along line 4—4 of FIG. 3.

A diffuser conduit is connected to end 38b of distributor header 38. Diffuser conduit 100 comprises a conduit having an outside diameter less than the inside diameter of distribution header 38, so as to provide an annular space 86' (FIG. 4) serving as part of liquid flow path 86. Diffuser conduit 100 extends from end 38b of distribution header 38 for slightly more than one-half the length thereof and terminates in an open end 100a thereof. Adjacent end 100a of diffuser conduit 100, a spacer bolt 102 (as seen in FIG. 4) passes through suitable radially extending holes provided in diametrically opposite portions of the wall of diffuser conduit 100. Spacer bolt 102 is secured to conduit 100 by nuts 104. Spacer bolt 102 has a length which is only slightly less than the inside diameter of distribution header 38 so that the opposite ends of bolt 102 contact or are only slightly spaced from the inside walls of distribution header 38 to substantially center diffuser conduit 100 within distribution header 38.

Figure 5:
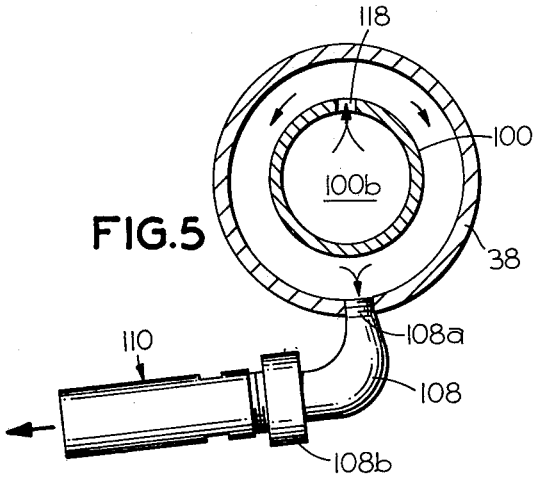
FIG. 5 is a section view taken along line 5—5 of FIG. 3 and showing one of the plurality of nozzles which are connected to the distribution header.

As seen in FIG. 4, distribution header 38 has a radially extending nozzle connector opening 106 formed in the wall thereof. A plurality of such nozzle connector openings 106 are spaced apart longitudinally along distribution header 38. Nozzle connector openings 106 are aligned along a longitudinally extending line in the wall of distribution header 38 and open liquid flow path 86 to liquid flow communication exteriorly of distribution header 38. Each of nozzle connector openings 106 has, as illustrated in FIG. 5, an elbow connector 108. Elbow connector 108 may comprise an elbow having an externally threaded tapered end 108a sized to be threadably connected to nozzle connector openings 106, which are suitably threaded for the purpose. Elbow 108 at its opposite end has an enlarged head 108b which is internally threaded to threadable receive a nozzle 110.

Figure 6:
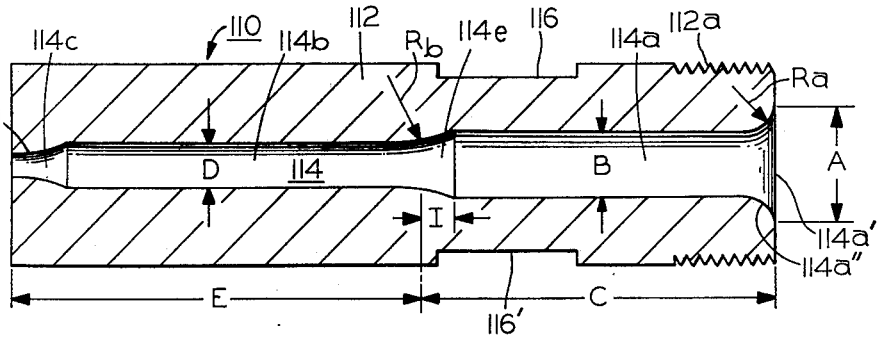
FIG. 6 is a longitudinal section view of the nozzle illustrated in FIG. 5.

A typical nozzle 110 is shown in longitudinal section in FIGS. 6 and 6A and comprises a body portion 112 in which is provided a liquid passage 114 having an inlet portion 114a, which is merged tangentially into an intermediate portion 114b by a curved intermediate transition portion 114e, and a tapering throat portion 114c which merges tangentially into a short cylindrical discharge opening 114d of circular cross section. Inlet portion 114a is seen to be of larger diameter than intermediate portion 114b, which in turn is of larger diameter than cylindrical discharge opening 114d. Inlet portion 114a has an inlet opening 114a' which is of larger diameter than inlet portion 114a and tangentially merges into the latter by means of a curved inlet transition portion 114a''. Dimension arrows A, B and C and radius arrow Ra indicate dimensions associated with inlet portion 114a. Dimension arrows D and E indicate dimensions associated with intermediate portion 114b. As shown in FIG. 6A, dimension arrow F and radius arrow Rc indicate dimensions associated with tapering throat portion 114c. Dimension arrows G and H indicate dimensions associated with cylindrical discharge opening 114d and dimension arrow I and radius arrow Rb are associated with transition portion 114e.

Body portion 112 has a pair of opposed flat land portions 116, 116' on opposite exterior sides thereof and an externally threaded end 112a which is adapted to be threadably engaged with internal threads provided in head portion 108b of elbow 108.

Referring to FIG. 5, diffuser conduit 100 has a plurality of diffuser openings 118 formed therein. Diffuser openings 118 are spaced apart longitudinally along the wall of diffuser conduit 100 to communicate the interior 100b of diffuser conduit 100 in liquid flow communication with liquid flow path 86 for purposes to be described hereinbelow.

Referring to FIGS. 7 and 8, it will be noted that header connector section 36' of second conduit 36 comprises a flexible conduit such as a hose and further, that by loosening bolts 85 (FIG. 8) which secure U-shaped clamping members 84, 84' to steel support plates 80, 80', distribution header 38 may be rotated relative to steel plates 80, 80' to orient nozzles 110 downwardly at a selected incident angle. The downward declination of nozzles 110 is illustrated in FIG. 5.

Figure 9:
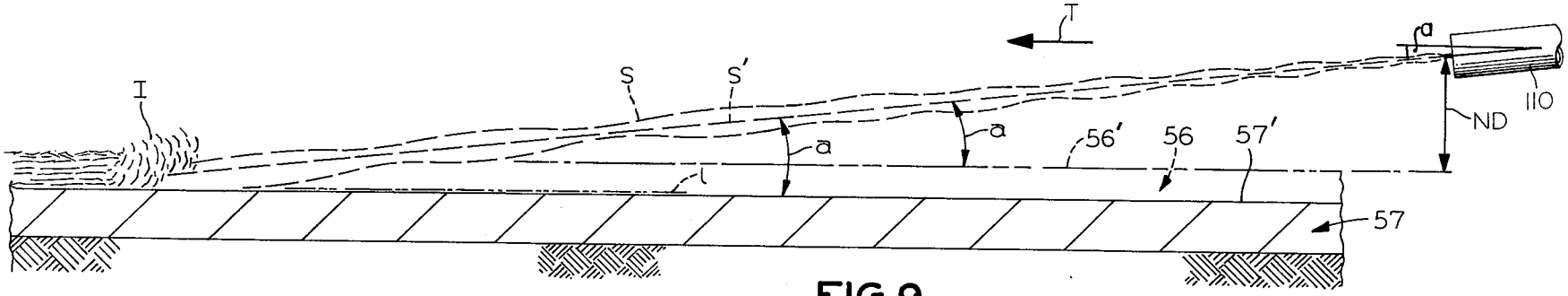
FIG. 9 is a partial side elevation view showing a stream of liquid being directed from a nozzle such as that illustrated in FIG. 5 onto frozen water on a ground surface.

FIG. 9 illustrates one of the plurality of nozzles 110 positioned above a ground surface 57 on which a layer of frozen water 56 is disposed, and which is sought to be removed therefrom. Streams S of a pressurized deicer liquid, preferably brine, are directed from nozzles 110 upon the layer of frozen water 56. Typically, ground surface 57 would be the surface of a road, highway, driveway, airport landing strip or any other ground surface from which it is desired to remove accumulated packed snow, ice, sleet or the like. Distribution header 38 is so oriented relative to ground surface 57 (and frozen water layer 56) that the longitudinal axis S' of a typical coherent stream of liquid S is discharged from nozzle 110 to define an incident angle a with frozen water layer 56, more specifically with the top surface 56' thereof. Angle a is an acute angle of between about one to five degrees. Since frozen water layer 56 will frequently substantially conform to surface layer 57, the identical angle a is formed between longitudinal axis S' and top surface 57' of ground layer 57. It has surprisingly been found, in accordance with the invention, that by maintaining substantially this acute incident angle the impact of the high pressure liquid stream S into frozen water layer 56 is maximized, and the tendency of the liquid stream to rebound away from the frozen water layer minimized. This promotes mechanical breaking up of the frozen water layer 56 by the high pressure stream S, and admixture of the brine or other deicer liquid with the mass of frozen water layer 56 rather than just superficial surface application to surface 56'. As will be appreciated, the angle a is the same as the angle a' formed between the horizontal plane defined by the nozzle support means 24 and the longitudinal axis of the nozzles 110.

It has also been found that, as opposed to applying the deicer liquid in the form of a spray or sheets of liquid, maintaining the liquid in a coherent, i.e., generally non-diverging, generally cylindrical stream of laminar flowing liquid, provides a high energy impact on the frozen water layer. This impact is enhanced by distributing the liquid through a nozzle 110 under conditions which impart to the outer boundary layer of the liquid stream S, i.e., the outer periphery surface thereof, conditions of turbulent flow. Thus, the streams of liquid S have a dense, laminar flowing core having an outer turbulent liquid layer. This maximizes the "drilling" or cutting effect of the high energy stream into the frozen water layer. As indicated in FIG. 9, stream of liquid S maintains a narrow, generally cylindrical configuration for substantially its entire length and impacts frozen water layer 56 in an impact area I in which the frozen water is mechanically broken and penetrated by the brine. A layer of brine lqiuid is formed on surface 57' or within frozen water layer 56.

The center line of nozzle discharge opening 114d is maintained a distance, indicated by dimension line ND, above top surface 56' of frozen water layer 56. Distance ND may vary but is preferably between about 5 to 10 centimeters (about 2 to 4 inches) above frozen water layer 56. Generally, frozen water layer 56 will follow the outline of ground surface 57. Obviously, there will occur rises and depressions in frozen layer surface 56, wheel ruts and the like. But generally speaking, nozzles 110 will be positioned at the required distance and orientation to frozen water layer 56 since wheels 72 will ride on frozen water layer 56 to properly position header 38 and the plurality of nozzles 110 thereon above the frozen water layer. To the extent that wheels 72 may sink into frozen water layer 56, the top portion thereof will be loose snow or slush, and nozzles 110 will be properly oriented with respect to the underlying frozen water layer. Thus, wheels 72 cooperate with the telescoping structure of the struts to properly position nozzles 110 with respect to the roadway. Nozzles 110 are so oriented that their nozzle discharge openings (114*d*, FIG. 6 and 6A) lead in the direction of nozzle travel, which is the direction travel of truck 10, indicated in FIG. 9 (and other figures) by arrow T. Thus, to the voluntary liquid streams S, a major component of the truck forward velocity will be added.

While applying the specified type of liquid stream at the specified incident angle closely above the frozen water layer provides the highly advantageous results of penetration, mechanical breakup and brine distribution described above, it was found that if the streams of liquid S were applied parallel to the direction of travel T as illustrated in Part A of FIG. 10, a furrow result was obtained. Referring to Part A of FIG. 10, the arrows S indicate the projection of streams S on a heading parallel to the direction of travel T of the truck and, consequently, parallel to the direction of travel of nozzles 110 (unnumbered in FIG. 10). The resultant impact areas I of the streams on frozen water layer 56 are elongated and disposed substantially parallel to the direction of travel T. The result is a series of furrows F of impacted area formed in those portions of frozen water 56 on which the brine or other deicer liquid has been applied. Undisturbed areas of frozen water are disposed between the furrows. This "corduroy" or furrow effect was overcome by projecting the streams of liquid S at a heading which describes an acute angle b with the direction of travel T, as illustrated in Part B of FIG. 10. Angle b is measured in a horizontal plane, between a vector line in the plane and the geometric projection onto the plane of longitudinal axes S' of streams S. By thus projecting stream S at an acute angle heading, the elongated impact areas I in frozen water layer 56 overlap each other in the direction of travel T and the result is a uniformly impacted area U being left behind.

Although the furrowed effect is preferably avoided, it still results in a greatly weakened and broken up frozen water layer 56 having a grid of melting and broken area and greatly facilitates removal of the layer by mechanical means such as a snowplow. Nonetheless, the uniformly impacted area U is preferred and results in reducing the entire frozen water layer into a slush of melting and broken material which can even more readily and efficiently be removed by a snowplow or other mechanical means. In some cases, the streams of liquid themselves suffice to substantially completely remove the frozen water layer.

In operation, tank 20 is filled from a source of deicer liquid, for example, a brine solution, as described above. After the filling operation is completed, pump 22 is started and the brine is circulated from first conduit 26, through pump 22, thence through high pressure second conduit 36. Valves 40 and 42 are positioned to recirculate brine via tank supply line 46 back to tank 20. The apparatus, which is typically mounted on a truck such as truck 10, is then transported to the road or other ground surface containing the frozen water layer onto which the liquid is to be applied. With the truck traveling over the frozen watercovered ground surface, valve 42 is operated to direct the pressurized brine from first conduit 36 through header connection segment 36' thereof into distribution header 38. The pressurized brine liquid passes from distribution header 38 through the liquid passages 114 formed in a plurality of nozzles 110 and is discharged therefrom as a coherent laminar stream of liquid having a turbulent boundary layer. Distribution header 38 is so positioned rationally, on plates 80, 80', on nozzle support means 24 that the strames of liquid are directed at an incident angle a of between about one to five degrees onto the surface of the frozen water layer. Distribution header 38 is positioned angularly (due to the selected different lengths of beams 60, 60') so as to further orient nozzles 110 to direct streams S of liquid onto the frozen water layer at a heading which defines an acute angle with the direction of movement of the nozzles by the truck. This acute angle is preferably ten degrees although it may vary, for example an acute angle of between about five to fifteen degrees or even more is satisfactory.

The forward movement of the nozzles is provided by the truck traveling across the road or other ground surface. The rate of applying brine to the frozen water layer may be controlled, in the illustrated preferred embodiment, by adjusting pressure relief valve 40. If valve 50 is opened, a portion of the brine passing through pump discharge segment 36" of second conduit 36 will be bypassed and recirculated back to tank 20. If the rate of application is desired to be increased or decreased, the operating pressure is adjusted by appropriately setting pressure relief valve 40. Obviously, increasing or decreasing the truck speed also respectively decreases or increases the rate at which deicer liquid is applied to a given area.

As indicated above, it is necessary, in order to attain the benefits of the invention, that liquid streams S be imposed onto the frozen water layer 56 at the incident angle specified. Further, it is preferred, in order to avoid the furrowing effect described above, that the streams of liquid be projected also at a heading which defines an acute angle with the direction of travel of the nozzles. FIG. 7 illustrates that one manner of attaining the desired heading of the projected liquid streams S is to position liquid distribution header 38 at the desired acute angle to the truck axles so that the distribution header longitudinal axis is disposed at the desired angle to the direction of forward movement of the vehicle. Part B of FIG. 10 illustrates an alternate or supplemental mode of adjusting the heading at which the streams S are projected, which is to swivel the nozzles relative to the longitudinal axis of distribution header 38. This projects streams S at an angle to the longitudinal axis of header 38. With this latter arrangement, distribution header 38 may be mounted on truck 10 parallel to the axles thereof. In such case, horizontal beam member 60, 60' may be made the same length rather than different lengths as illustrated in FIG. 7, wherein header 38 is mounted at an angle (acute angle a) to the axles of truck 10.

Referring to FIGS. 2, 5 and 8, brine or other deicer liquid is pumped through header connection 36' into diffuser conduit 100 which provides a space **100*b* which serves as a liquid conduit. A portion of the pressurized liquid passes through diffuser openings 118 directly into the annular space 86' and from thence through elbow connectors 108 to be discharged from their associated nozzles 110. The balance of the brine or other deicer liquid emerges from open end 100*a* of diffuser conduit 100 and directly into liquid passageway 86, in that portion of distribution header 38 in which diffuser conduit 100 does not extend. The liquid then passes through the remaining elbows 108 and their associated nozzles 110. The purpose of diffuser conduit 100 is, as is well known in the art of supplying liquid to a plurality of nozzles, to assist in supplying the liquid at approximately the same pressure to each of the various nozzles. Without diffuser conduit 100 the liquid would be supplied at a higher pressure to those nozzles 110 which are closer to header connection segment 36' than to nozzles 110 more remote from end 38*b***.

The flow of the deicer liquid from diffuser conduit 100 into distribution header 38 and thence through elbows 108 and nozzles 110 is illustrated by the arrows in FIG. 5.

A nozzle which gives the desired coherent laminar stream of liquid having a turbulent outer layer has been found to comprise a nozzle having a contracting liquid passageway (114) commencing with an inlet opening (**114*a'*) which is flared outwardly facing the upstream direction of the liquid. The liquid passageway has an inlet passageway (114*a*) which tapers, via a transition section (114*e*) which is flared facing the upstream direction, into an intermediate passageway (114*b*) of lesser diameter than the inlet passageway. In turn, the intermediate section merges into an upstream facing flared throat section (114*c*). The throat section has a generally conoidal or truncated cone shaped configuration which terminates in a cylindrical discharge opening (114*d***). Thus, the nozzle has, in effect, a contracting (in direction of liquid flow) liquid passageway terminating in a throat portion which terminates in a cylindrical discharge opening.

As will be readily understood by those having knowledge of the art, the dimensions of the nozzle and conduits and the capacity and operating characteristics of the pump and motor will vary with the desired volume to be dispensed from each nozzle while still maintaining the desired fluid pressure.

Exemplary of the apparatus of the present invention is the data set forth hereinafter.

EXAMPLE

An assembly substantially as illustrated in the drawings uses a high pressure positive displacement triplex pump manufactured by FMC Corp. -Agricultural Machines Division, Jonesboro, Ark. and designated John Bean Model L1122D-1, and a gasoline engine made by the Wisconsin Motor Corporation of Milwaukee, Wis., designated Wisconsin Heavy Duty Engine Model VF 4D with a rating of 25 H.P., 107.7 cubic inches. To minimize corrosion, the pump has a nickel coating and the cylinders are ceramic coated steel. The pump is capable of delivering 283.9 liters per minute (75 gpm) at 21.1 kg/cm$^2$ (300 psi).

Using such an assemblage, satisfactory results have been obtained by use of a nozzle which has the following dimensions, which are keyed to the drawings of FIGS. 6 and 6A. The nozzle is made from round bar stock, SAE No. 30303-AISI Type 303 stainless steel. Obviously, other suitable material may be employed. The dimension of land portions 116, 116' are not critical since the land portions merely provide a convenient means for gripping of the nozzle by a wrench or similar tool for tightening it into the threaded opening.

| Fig. | Dimension Line/Radius | Length cm (inches) |
|---|---|---|
| 6 | A | 1.715 (0.675) |
| 6 | B | 0.650 (0.256) |
| 6 | C | 3.175(1.250) |
| 6 | D | 0.406(0.160) |
| 6 | E | 3.493(1.375) |
| 6 | F | 0.356(0.140) |
| 6A | G | 0.203(0.080) |
| 6A | H | 0.102(0.040) |
| 6A | I | 0.356(0.140) |
| 6 | R (Radius) | 0.318(0.125) |
| 6 | R (Radius) | 0.635(0.250) |
| 6A | R (Radius) | 0.635(0.250) |

All tolerances are ±0.127 mm (±0.005 inches) except for dimension G, the tolerance for which is −0.051 mm, +0.000 (−0.002 inches +0.000). The exterior thread is standard 3/8 inch pipe thread.

While the deicer storage tank may be of any convenient size and construction, a suitable form of construction has been found to be a reinforced fiberglass tank having a cylindrical middle section closed at the ends by a segment of a sphere. This is the general shape illustrated in FIGS. 1 and 2 of the drawings. The tank has an overall length of 2.44 meters (8 feet) an overall height of 1.83 meters (6 feet) and spherical segment end portions. The tank may be supported upon the bed platform of the truck in a suitable steel cradle or equivalent support means. Interior baffle walls are helpful to minimize sloshing when the tank is partially empty.

A successfully tested prototype of an embodiment of the apparatus in accordance with the present invention is mounted upon a standard nine ton (short ton) maintenance truck chassis of 13,154 kilograms (29,000 pounds) gross vehicle weight. Storage tank 20 consists of a 5,678 liter (1,500 gallons) reinforced fiberglass tank seated upon a steel cradle. A distribution header of the type illustrated in the drawings, i.e., one equipped with a diffuser conduit is provided with a total of twenty-eight liquid distributing nozzles of the type illustrated herein. The nozzles are spaced apart along the longitudinal axis of the distribution header. The distribution header is a pipe 2.4 meters long (8 feet) with an inside diameter of 7.6 centimeters (3 inches). First and second conduits are of flexible tubing. The nozzle support means is that illustrated in FIGS. 1, 7 and 8 and is provided by two sets of telescoping box beams of the type illustrated in FIG. 8 of the drawings. Wheels and lifting cables substantially as shown in FIG. 8 are provided. The cables are attached to a hydraulically powered rod to raise the wheels when the unit is not in use. When in the liquid distributing position, the height of the nozzles above the surface on which the wheels ride is approximately 7.6 meters (3 inches) above the surface measured from the centers of the nozzle discharge openings. The nozzles are oriented at an incident angle (a) of about 3° and at a heading to define an angle (b) of about 10° with the direction of movement of the truck and nozzles. When not in use, the assembly is raised by raising the cables through a system of pulleys (not shown in the drawings)

to provide a clearance of approximately 22.8 centimeters (9 inches) above the surface on which the truck is traveling.

At a truck speed of 48.3 kilometers per hour (30 miles per hour) and a liquid pressure of 21.1 kg/cm$^2$(300 psi) at the nozzles, brine is applied at a rate of 283.9 liters (75 gallons) per minute to the ground surface. When using a fully saturated brine solution, this corresponds to an application rate of crystalline salt of 89.9 kilograms (198 pounds) of crystalline salt per lane-mile.

Road tests were carried out with the unit described above as follows on a test road comprising a section of Interstate Highway I-84 between its junctions with Route 229 (West Street) in the town of Southington, Conn. and Route 70 in Cheshire, Conn. This includes a long continuous grade over Southington Mountain. This section of the road rises 97.5 meters (320 feet) over a distance of 2.9 kilometers (1.8 miles). This test section covers approximately 25.6 lane-kilometers (15.9 lane-miles) on the westbound roadway, including the truck-climbing lane. The corresponding eastbound roadway runs concurrently with the westbound test section and contains approximately 22.7 lane-kilometers (14.1 lane-miles). The trucks applying crystalline salt in the eastbound control comparison section were responsible for a total of 99.7 lane-kilometers (61.85 lane-miles). The total tonnage stated for the eastbound control comparison section is that used over a distance of 99.7 lane-kilometers (61.85 lane-miles).

The unit was tested during the four winter storms in the extremely cold winter of 1976–1977. The nature of the precipitation in two of the storms was such that brine was applied only in isolated areas on the test section and an evaluation and comparison with the application of crystalline salt was not possible. During four severe storms, the brine was applied as described below.

The westbound test section and the eastbound control comparison section were inspected both before and after applications of brine in which the westbound section with the test unit, and crystalline salt in the eastbound section. The general condition of both roadways was also evaluated during the storm.

Test Storms

Storm 10. Dec. 26, 1976. Total Precipitation: 7.6 cm (3 in.) of Snow. Temperature: −2° C. (28° F.)

The pavement cover in all areas consisted of mealy snow to a thin pack not exceeding 0.6 cm (¼ in.). After a brine application, the pavement was wet with spotty pack which was broken up by traffic. A total of three applications requiring approximately 2838.8 liters (750 gallons) were made during this storm at time intervals of about two and one-half to three hours. This represents a total of approximately 2.7 metric tons (3 tons) of salt or 0.17 metric ton (0.19 ton) per lane-mile. A total of 55 tons (49.9 mt) or 0.89 ton (0.8 mt) per lane-mile were used in the control section.

Storm 11. Dec. 28, 1976. Total Precipitation: 2.5 cm (1 in.) of Snow. Temperature: −8° C. (17° F.)

The pavement cover in all areas consisted of spotty, thin pack. Upon application of the brine, the pavement became wet with slush in spots. Approximately 5109.9 liters (1350 gallons) of brine, equivalent to 1.6 metric tons (1.8 tons) or 0.1 metric ton (0.11 ton) of salt per lane-mile were applied to the westbound test section. 40.8 metric tons (45 tons) of crystalline salt was applied to the eastbound control section, i.e. 0.6 metric tons (0.73 ton) of crystalline sale per land-mile.

Storm 14. Jan. 7, 1977. Total Precipitation: 22.4 cm (8.8 in.) of Snow. Temperature: +1° to −3° C. (33° to 26° F.)

The pavement cover consisted of a mealy snow. The pavement was wet and clear after each application of brine. A total of 8516 liters (2250 gallons) of 85 percent saturated brine was used, equivalent to 2.2 metric tons (2.5 tons) of salt, or 0.14 metric tons (0.16 tons) of salt per lane-mile. A total of 50 metric tons (55 tons) of crystalline salt was used on the eastbound control section, or 0.8 metric tons (0.89 tons) per lane-mile.

Storm 23. Feb. 5, 1977. Total Precipitation: 9.1 cm (3.6 in.)-Ice Glaze-Temperature: −1° to −8° C. (30° to 17° F.)

Modifications being made to the piping system were not completed for use during the storm. After the storm, snow which drifted across the highway froze due to a sudden drop in temperature and, as a consequence, the 2.9 kilometer (1.8 mile) grade was closed to traffic. The prototype unit was sent out with 5,677.6 liters (1500 gallons) of 65 percent saturated brine. The high velocity liquid streams were capable of removing the ice on contact. The roadway was opened to traffic while the prototype was still making the application of brine.

A total of approximately 2,835.8 liters (750 gallons) or the equivalent of 0.5 tons (0.64 ton) of salt was used for this application, or 0.1 metric ton (0.12 ton) per lane-mile.

Summary of Test Results

| Storm No. | Total Precipitation | Roadway Cover | Total Brine Applied-Liters | Results |
|---|---|---|---|---|
| 10 | 7.6 cm (3") Snow | Mealy Snow Thin Pack | 8517.2 (2,250 gal.)(1) | Pavement Wetted Pack Broken |
| 11 | 2.5 cm (1") Snow | Thin Pack | 5110.3 (1,350 gal.)(1) | Pavement Wet with Slush |
| 14 | 22.4 cm (8.8") Snow | Mealy Snow | 8517.2 (2,250 gal.)(2) | Pavement Wet and Clean |
| 23 | 0 | Ice | 2839.1 ( 750 gal.)(3) | Ice Removed on Contact |

(1)Fully Saturated Brine Solution Used
(2)85% of Saturation Brine Solution Used
(3)65% of Saturation Brine Solution Used

| Comparision of Crystalline Salt vs Brine Used Metric Ton per lane mile (Short Ton per lane mile) | | |
|---|---|---|
| Storm No. | (Eastbound Roadway) Crystalline Salt | (Westbound Roadway) Salt Brine |
| 10 | 0.81 (0.89) | 0.17 (0.19) |
| 11 | 0.66 (0.73) | 0.10 (0.11) |
| 14 | 0.81 (0.89) | 0.15 (0.16) |
| 23 | — | 0.11 (0.12) |

Discussion of Test Results

Due to their proximity, the westbound test and eastbound control sections exhibited virtually the same pavement conditions for each storm prior to application of the brine and salt. The snow or ice that built up on the eastbound control pavement demonstrated little tendency to melt on application of the crystalline salt; the only bare areas formed were primarily in the wheel paths of the outer lane. The pack or ice showed signs of melting only toward the end of the storm, depending on ambient temperature.

The pavement in the westbound test section to which brine was applied in the form of high velocity liquid streams in accordance with the invention was normally wet and clear within a few minutes after an application. What snow cover was not destroyed by the liquid streams was loose and easily plowable, or destroyed by passing vehicles.

Conclusions

As indicated above, application of brine solution in accordance with the invention shows highly satisfactory results in terms of a removal of snow, ice, etc. In one of the tests, ice was removed on contact. Further, a reduction in the total equivalent amount of salt required was attained by practice of the invention. The results tabulated above indicate that an 80 percent reduction in salt requirement may be attainable with the invention as compared to the amount of crystalline salt required to obtain equivalent results. Although different storm and icing conditions would provide somewhat different results, at a conservative estimate it appears that a salt reduction of at least one-half of the salt required for crystalline application may be possible by applying brine solution in accordance with the invention. Aside from substantial cost savings, the reduction in the amount of salt required provides distinct environmental benefits and reduces corrosion attack on vehicles using the treated roadways, and structures appurtenant to and adjacent to the roadways.

In general, the invention calls for applying the liquid streams at an incident angle of one to five, most preferably three degrees. The pressure of the deicer liquid in the distribution header is preferably between about 14.0 to 21.1 kg/cm$^2$ (200 to 300 psi). At a pressure of 16.2 kg/cm$^2$ (230 psi) the velocity of the stream jet is approximately 45.1 meters per second (148 feet per second), and ignoring the slight inclination of the incident angle, this velocity is additive to the velocity of the truck in establishing the total relative velocity between the streams and the frozen water layer onto which it is directed.

It will be apparent upon a reading and understanding of the foregoing, that numerous alterations and modifications may be made to the particular illustrated preferred embodiment which are nonetheless within the scope and spirit of the present invention. Obviously, the apparatus of the invention may be mounted on a vehicle other than a truck, for example a trailer towed by a truck or other means, or any other type of maintenance vehicle. Generally, any ground vehicle having a platform to support the apparatus and at least a pair of wheels mounted on an axle will suffice. The apparatus itself may be considerably modified as compared to the illustrated embodiments and still provide the streams of liquid of the specified type at the specified orientation onto the frozen water surface. As used herein, the term "frozen water" is intended to broadly include snow, packed and refrozen snow, ice, sleet, compacted hail, frozen slush, and in general any form of frozen water of the type which accumulates on ground surfaces such as roads and the like.

What is claimed is:

1. A method of applying a deicer liquid to frozen water on a ground surface comprising the steps of:

(a) pressurizing a brine solution to at least about 14.0 kg/cm$^2$;

(b) supplying the pressurized liquid of step (a) to a plurality of liquid directing nozzles having a body portion in which is provided a liquid passage terminating in a generally circular discharge opening, said liquid exiting from said discharge openings as coherent laminar streams of liquid having a generally cylindrical configuration and a turbulent outer boundary layer;

(c) orienting said nozzles relative to the ground surface to direct said streams of liquid onto the frozen water at an incident angle to the ground surface of between about one to five degrees; and (d) moving said nozzles and thereby said streams of liquid across said ground surface in a direction generally parallel thereto and whereby movement of said nozzles increases the relative velocity at which said streams impinge upon said frozen water.

2. The method of claim 1 including in step (c) further orienting said nozzles to direct said streams of liquid at a heading which defines an acute angle with the direction of movement of said nozzles.

3. The method of claim 1 in step (a) pressurizing said brine solution to between about 14.0 kg/cm$^2$ to 21.1 kg/cm$^2$.

4. The method of claim 1 wherein said brine solution is a saturated brine.

5. A deicer apparatus adapted to be mounted on a ground vehicle for applying deicer liquid to a layer of frozen water on the ground surface over which the vehicle travels, comprising:

(a) a deicer liquid storage tank having a tank outlet;

(b) pump means having pump inlet and a pump outlet and adapted to pressurize a liquid received through said pump inlet to a pressure of at least about 14.6 kg/cm$^2$;

(c) first conduit means connecting said tank outlet in liquid flow communication to said pump inlet;

(d) a plurality of liquid directing nozzles having a body portion in which is provided a liquid passage terminating in a generally circular discharge opening and configured to discharge pressurized liquid from said pump through said discharge opening as a coherent laminar stream of generally cylindrical configuration and having a turbulent outer boundary layer;

(e) second conduit means connecting said pump outlet in liquid flow communication with said nozzles;

(f) nozzle support means carrying said nozzles and including means thereon for mounting said support means on a ground vehicle, said nozzle support means being configured to support said nozzles above the ground surface for movement thereover by the vehicle, and said nozzles being disposed on said support means to orient said discharge openings to lead in the direction of vehicle forward travel with the axes thereof at an angle to the horizontal plane defined by said mounting means of about one to five degrees and thereby to direct said streams of liquid from said nozzles at an incident angle to the layer of frozen water of about one to five degrees.

6. The apparatus of claim 5 wherein said nozzles are disposed on said support means with their axes disposed at an acute angle to the longitudinal axis of said support means and thereby to orient said nozzle discharge openings to direct said streams of liquid from said nozzles at a heading defining an acute angle with the direction of movement of said nozzles along the direction of vehicle forward travel.

7. The apparatus of claim 6 wherein said axes of said nozzles are disposed at an angle of about 80° to the longitudinal axis of said support means whereby said heading defines an angle of about ten degrees with the direction of movement of said nozzles.

8. The apparatus of claim 6 wherein said nozzles are disposed on said support means with the angle defined between the axis and the horizontal plane of the mounting means being about three degrees and thereby to orient said discharge openings to direct said streams of liquid at an incident angle of about three degrees.

9. The apparatus of claim 5 wherein said second conduit includes an elongated distribution header providing a liquid flow path extending along its longitudinal axis, and a header connection segment connecting said liquid flow path in liquid flow communication with said pump outlet, and said plurality of nozzles are connected to said distribution header in spaced apart relationship along said longitudinal axis thereof and in liquid flow communication with said liquid flow path.

10. The apparatus of claim 9 wherein said nozzle support means includes a pair of spaced apart struts having upper and lower portions, said means for mounting said support means are on said upper portions of said struts, and further including a pair of header support members respectively connected to said lower portions of said struts, said distribution header being supported by said header support members.

11. The apparatus of claim 10 wherein at least said second conduit means is a flexible conduit, said struts are of telescoping construction, and further including means to selectively move said struts between a retracted position and a lower liquid applying position above the ground surface.

12. The apparatus of claim 11 wherein said struts are vertically disposed and said header support members are horizontally disposed.

13. The apparatus of claim 11 further including a wheel mounted at the lower portions of said struts, said wheels being adapted to ride on a roadway to position said nozzles thereabove.

14. The apparatus of claim 9 wherein said distribution header is rotatable about its longitudinal axis relative to said header support members to adjust the orientation of said nozzles and thereby adjust the angle between the axes thereof and the horizontal plane defined by said mounting means and thereby said incident angle.

15. A deicer apparatus mounted on a ground vehicle for applying deicer liquid to a layer of frozen water on the ground surface over which the vehicle travels, comprising:

(a) a ground vehicle having at least a pair of wheels mounted on an axle;

(b) a support platform provided of said vehicle;

(c) a deicer liquid storage tank supported on said platform and having a tank outlet;

(d) pump means having pump inlet and a pump outlet and adapted to pressurize a liquid received through said pump inlet to a pressure of at least about 14.6 $kg/cm^2$;

(e) first conduit means connecting said tank outlet in liquid flow communication to said pump inlet;

(f) a plurality of liquid directing nozzles having a body portion in which is provided a liquid passage terminating in a generally circular discharge opening and configured to discharge pressurized liquid from said pump through said discharge opening as a coherent laminar stream of generally cylindrical configuration and having a turbulent outer boundary layer;

(g) second conduit means connecting said pump outlet in liquid flow communication with said nozzles, said second conduit including an elongated distribution header providing a liquid flow path extending along its longitudinal axis, and a header connection segment connecting said liquid flow path in liquid flow communication with said pump outlet, said plurality of nozzles being connected to said distribution header in spaced apart relationship along said longitudinal axis thereof and in liquid flow communication with said liquid flow path; and (h) nozzle support means carrying said nozzles and including means thereon for mounting said support means on said ground vehicle, said nozzle support means being configured to support said nozzles above the ground surface for movement thereover by the vehicle, and said nozzles being disposed on said support means (1) to orient said discharge openings to lead in the direction of vehicle forward travel, (2) with the axes thereof at an angle to the horizontal plane defined by said mounting means of about one to five degrees and thereby to direct said streams of liquid from said nozzles at an incident angle to the layer of frozen water of between about one to five degrees and (3) with their axes disposed at an acute angle to the longitudinal axis of said support means and thereby to direct said streams of liquid from said nozzles at a heading defining an acute angle with the direction of movement of said nozzles.

16. The apparatus of claim 15 wherein said nozzle support means comprises an undercarriage supported beneath said platform.

17. The apparatus of claim 16 wherein said nozzle support means includes telescoping strut members having wheels mounted on the lower portions thereof for riding on a roadway over which the ground vehicle travels.

* * * * *